US006810995B2

(12) United States Patent
Warford

(10) Patent No.: US 6,810,995 B2
(45) Date of Patent: Nov. 2, 2004

(54) PORTABLE STAIRS WITH ADJUSTABLE LANDING PLATFORM HEIGHT

(76) Inventor: Larry Warford, 6215 Bock Ave., Sumner, WA (US) 98390

( * ) Notice: Subject to any disclaimer, the term of this patent is extended or adjusted under 35 U.S.C. 154(b) by 0 days.

(21) Appl. No.: 10/101,102

(22) Filed: Mar. 18, 2002

(65) Prior Publication Data

US 2002/0153201 A1 Oct. 24, 2002

Related U.S. Application Data

(60) Provisional application No. 60/276,971, filed on Mar. 18, 2001.

(51) Int. Cl.[7] ..... E06C 7/16

(52) U.S. Cl. ..... 182/115; 182/151; 182/113; 52/182

(58) Field of Search ..... 182/115, 113; 52/182–191

(56) References Cited

U.S. PATENT DOCUMENTS

| | | | | |
|---|---|---|---|---|
| 2,531,778 A | * | 11/1950 | Merner | |
| 3,462,170 A | | 8/1969 | Smith et al. | |
| 3,693,754 A | | 9/1972 | Butler | |
| 3,698,511 A | | 10/1972 | Dohan | |
| 3,750,351 A | | 8/1973 | Greenburg | |
| 3,796,456 A | | 3/1974 | Bergeson et al. | |
| 3,808,757 A | | 5/1974 | Greenwood | |
| 3,912,298 A | | 10/1975 | Humphrey | |
| 4,042,064 A | | 8/1977 | Lobb | |
| 4,347,638 A | * | 9/1982 | Weaver | 182/115 |
| 4,418,792 A | * | 12/1983 | Cerone | 182/93 |
| 4,747,243 A | * | 5/1988 | Anstead | 52/184 |
| 4,759,162 A | * | 7/1988 | Wyse | 52/183 |
| 4,909,700 A | | 3/1990 | Fontecchio et al. | |
| 5,653,459 A | | 8/1997 | Murphy | |
| 6,085,867 A | | 7/2000 | Daniel, III et al. | |

* cited by examiner

*Primary Examiner*—Alvin Chin-Shue

(57) ABSTRACT

An adjustable stair and platform system. The apparatus includes a set of stairs which is affixable to a platform at a first height or alternately at a second height. Both the platform unit and the stair unit include vertically adjustable legs above ground engaging feet. The stairs includes a stair rail frame which is releasably affixable to a side hand rail frame provided for the platform unit. The hand rail frame provided for the platform unit includes an end rail which is pivotally mounted to the side hand rail frame. The end rail frame is changeable to support a right hand or a left hand configuration of the side hand rail frame provided on the platform unit. The combination of vertical adjustability, and left and right hand adjustability, make the unit adaptable for various installation configurations, and avoids the need for multiple stair system units for portable buildings.

33 Claims, 6 Drawing Sheets

PORTABLE STAIRS WITH ADJUSTABLE LANDING PLATFORM HEIGHT

RELATED APPLICATIONS

This application is based on, and claims priority from U.S. Provisional Patent Application Ser. No. 60/276,971, filed Mar. 18, 2001, the disclosure of which is incorporated herein by this reference.

TECHNICAL FIELD

This invention is directed to the field of portable stairs. More particularly, the invention is directed to improved stairs for use with mobile construction trailers and modular or pre-fab building structures, such as are commonly utilized on construction projects.

BACKGROUND

Various platforms have long been utilized for placing adjacent exit and entry ports, normally conventional doors, found in construction trailers and other similar portable structures. A wide variety of such structures have been known and utilized as appropriate for various applications. And, although most such stairs and accompanying platforms have historically been constructed with fixed, non-adjustable platform heights, a few alternate structures have been developed which, in some limited fashion or another, enable the user to accommodate or provide some adjustment in the platform height.

However, a common problem encountered in locating such structures which are known to me is that, when operating on uneven ground, such structures are often not uniformly adjusted (often are not even variably adjustable) to provide a level platform. Thus, those structures inevitably leave a gap of a few inches between the required or desirable platform height, and the actual platform height. Additionally, a certain amount of tilt often occurs if the stair and platform combination is not carefully set up or assembled, as the case may be. Also, it is often rather difficult to achieve a quick adjustment of the available adjustable designs, so, workmen often found to be simply too lazy or too pressed for time to properly make available adjustments. Often, the result is a job-site trailer with an entrance/exit stairs/platform which does not comply with applicable regulatory requirements, such as the Occupational Safety and Health Act (OSHA), or equivalent state acts, when the projects are in the United States.

Thus, there remains a continuing unmet need for a combination stairs/platform for portable structures which are adjustable in height, and which, even though the platform height is adjustable, can utilize a single stair design, and wherein both the stairs and the platform are fully compliant with applicable regulatory standards.

SOME OF THE OBJECTS, ADVANTAGES, AND NOVEL FEATURES

Accordingly, one objective of my invention is to provide a design for portable stairs which have an adjustable platform height.

Another objective of my invention is to provide a design for portable stairs in which the platform height is adjustable while the same set of stairs is utilized.

Another important objective is to provide a platform structure which is rapidly adjustable in height, yet retains the high strength necessary to support the design load with adequate safety factor.

A related and important objective is to provide a structure in which the platform legs are quickly adjustable, yet of high strength.

Another important objective is to provide a structure and design in a portable stair unit in which the stairs may be conventionally installed, yet can be installed in different heights attached to the same platform, rather than having the requirement for a new set of stairs when the platform height is adjusted.

Finally, another important objective is to provide a high strength portable stair structure which can be conveniently and easily built with conventional manufacturing processes, so that manufacturing costs are minimized.

BRIEF SUMMARY

I have now invented a portable platform and stairs for portable office buildings, where the platform is of adjustable height. This is important since it enables the platform to be reused at different sites, although uneven ground, or building setups of differing heights, is encountered.

My portable stair system has four major components. These components are a platform, a stair assembly, a stair handrail, and a platform handrail.

Importantly, my novel platform has individually adjustable legs, preferably at least four in number. I prefer to use a slidably adjustable mechanism that is securable with friction fit fasteners at any desired length, preferably from more than zero up to at least as much as fourteen inches in height. In this manner, the platform can be adjusted to fit any of the various portable office building types currently available.

Moreover, my platform stair system needs no extra bolts for assembly, and resultantly, it is one of the easiest to assemble stair systems available.

BRIEF DESCRIPTION OF THE DRAWING

In order to enable the reader to attain a more complete appreciation of the invention, and of the novel features and the advantages thereof, attention is directed to the following detailed description when considered in connection with the accompanying drawings, wherein.

The foregoing figures, being exemplary, contain various elements that may be present or omitted from actual implementations depending upon the circumstances. An attempt has been made to draw the figures in a way that illustrates at least those elements that are significant for an understanding of the various embodiments and aspects of the invention. However, various other elements of the platform and stairs system are also shown and briefly described to enable the reader to understand how various optional features may be utilized in order to provide a useful platform and stair system that is easily changed from various heights and to both left hand and right hand rail configurations.

DETAILED DESCRIPTION

Figure 1:
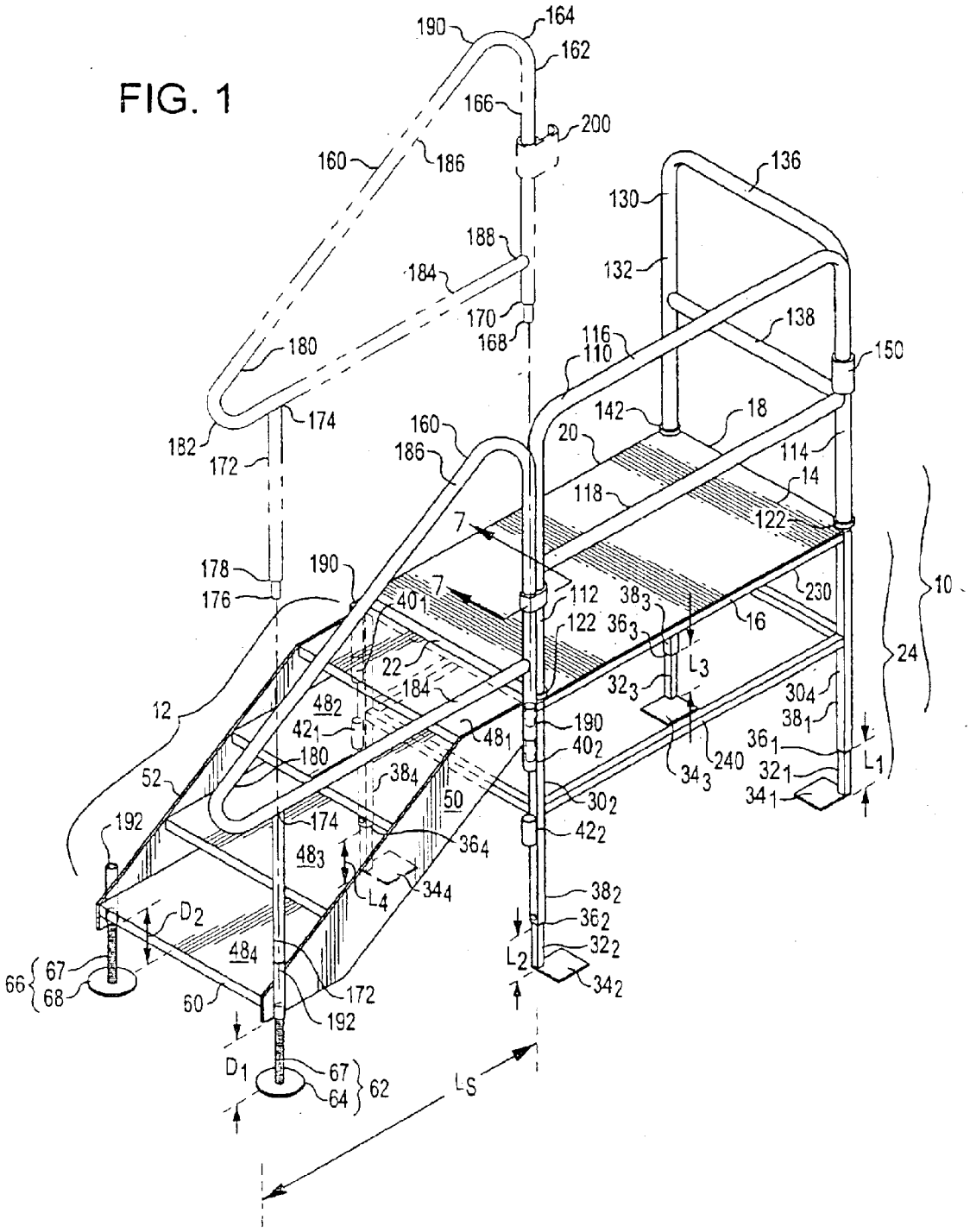
FIG. 1 is a partially exploded perspective view of my novel portable stair system for portable office buildings, showing the major parts and pieces, including the platform unit with (i) individually adjustable legs, and (ii) upper and lower stair unit receiving mounts, the stair assembly with a pair of individually adjustable feet and a pair of platform attachment pocket pins for mounting the stair assembly to either the upper or to the lower stair receiving mounts on the structural framework of the main platform, a stair handrail frame, and a platform unit hand rail frame.

Attention is directed to FIG. 1, where a perspective view of my portable platform stair system is illustrated. The system includes an adjustable platform unit 10 and stairs 12. At least one platform unit 10 is provided, having preselected dimensions and having a plurality of side portions, here, with a rectangular deck 14, side portions 16, 18, 20, and 22 are provided. Below the deck 14, a structural support framework 24 is provided to support the deck 14 of the platform unit 10. The structural support framework 24 has plurality of substantially vertical support leg members 30. Each of the vertical support leg members 30 has a vertically displaceable slide portion or lower member 32. Each of the slide portion lower members 32 has a foot 34 that is securable at a desired length L with respect to a lower end 36 of an upper tubular member 38 of the vertical support leg members 30. For example, a first lower member $\mathbf{32}_1$, has a foot $\mathbf{34}_1$ that is securable at a length $L_1$ with respect to lower end $\mathbf{36}_1$ of upper tubular support member $\mathbf{38}_1$. Likewise, a second lower member $\mathbf{32}_2$ has a foot $\mathbf{34}_2$ that is securable at a length $L_2$ with respect to lower end $\mathbf{36}_2$ of a second upper tubular support member $\mathbf{38}_2$. Thus, as in the embodiment illustrated, where four vertical support leg members 30 are provided, then a third lower member $\mathbf{32}_3$ has a foot $\mathbf{34}_3$ that is securable at a length $L_3$ with respect to lower end $\mathbf{36}_3$ of a third upper tubular support member $\mathbf{38}_3$, and a fourth vertical support leg member $\mathbf{30}_4$ has a fourth lower member $\mathbf{32}_4$ having a foot $\mathbf{34}_4$ that is securable at a length $L_4$ with respect to lower end $\mathbf{36}_4$ of a fourth upper tubular support member $\mathbf{38}_4$.

Along at least one of the plurality of side portions 16, 18, 20, and 22 at least one upper stair receiving member $\mathbf{40}_1$ and at least one lower stair receiving member $\mathbf{42}_1$, are affixed to a portion of said structural support framework 24. As illustrated in FIG. 1, a pair of upper stair receiving members (or "pockets") $\mathbf{40}_1$ and $\mathbf{40}_2$ are provided. Likewise, as illustrated in FIG. 1, a pair of lower stair receiving members (or "pockets") $\mathbf{42}_1$, and $\mathbf{42}_2$ are provided.

Figure 4:
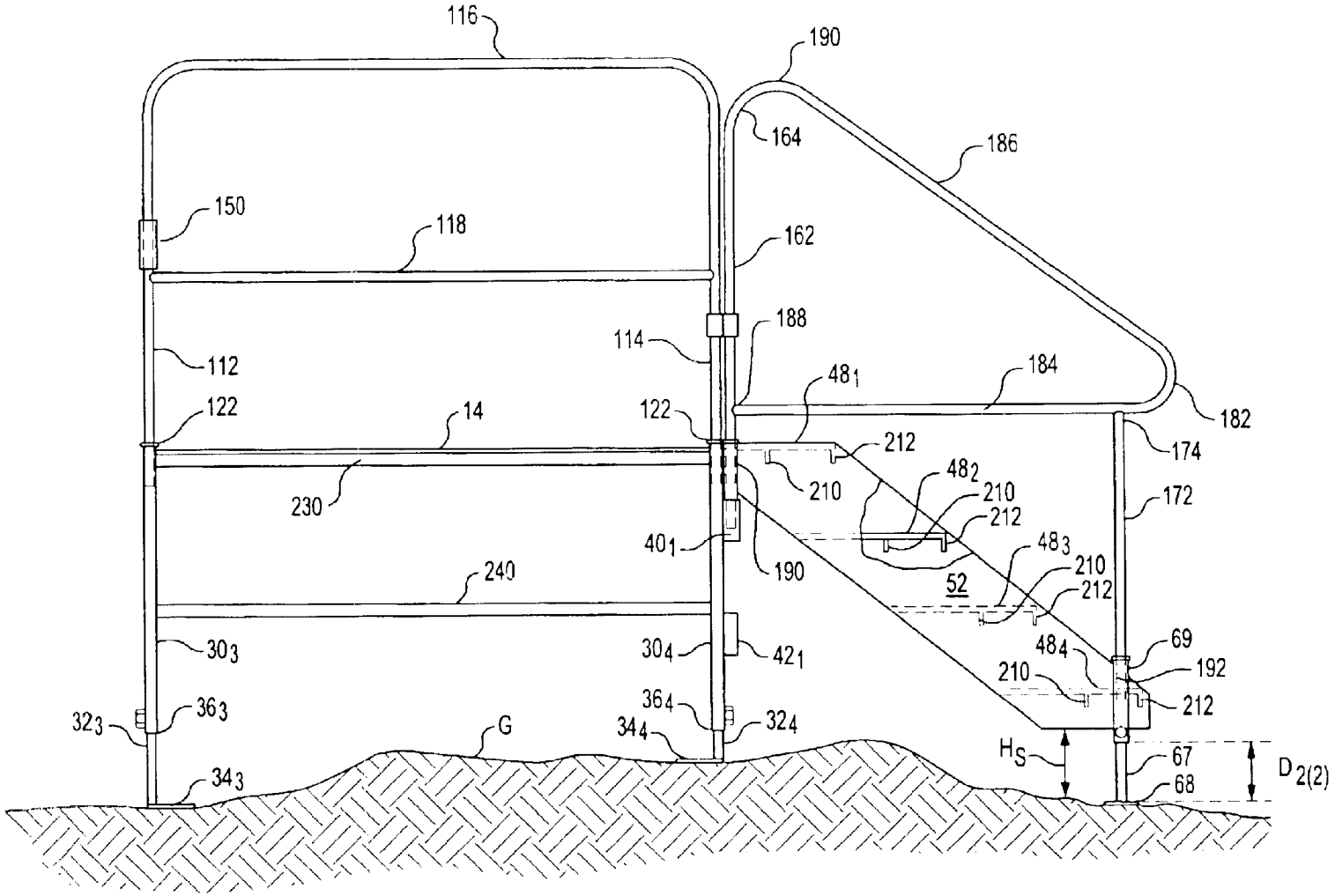
FIG. 4 is a side pictorial view of my portable stair system as first illustrated in FIG. 1, but now showing the stair assembly mounted to the upper stair receiving mounts of the structural framework for the main platform unit, and with the adjustable stair leg at a first extended length, and with one of the platform legs fully retracted, but with another platform vertical support leg member partially retracted, so as to provide level support of main platform unit over uneven ground.
Figure 5:
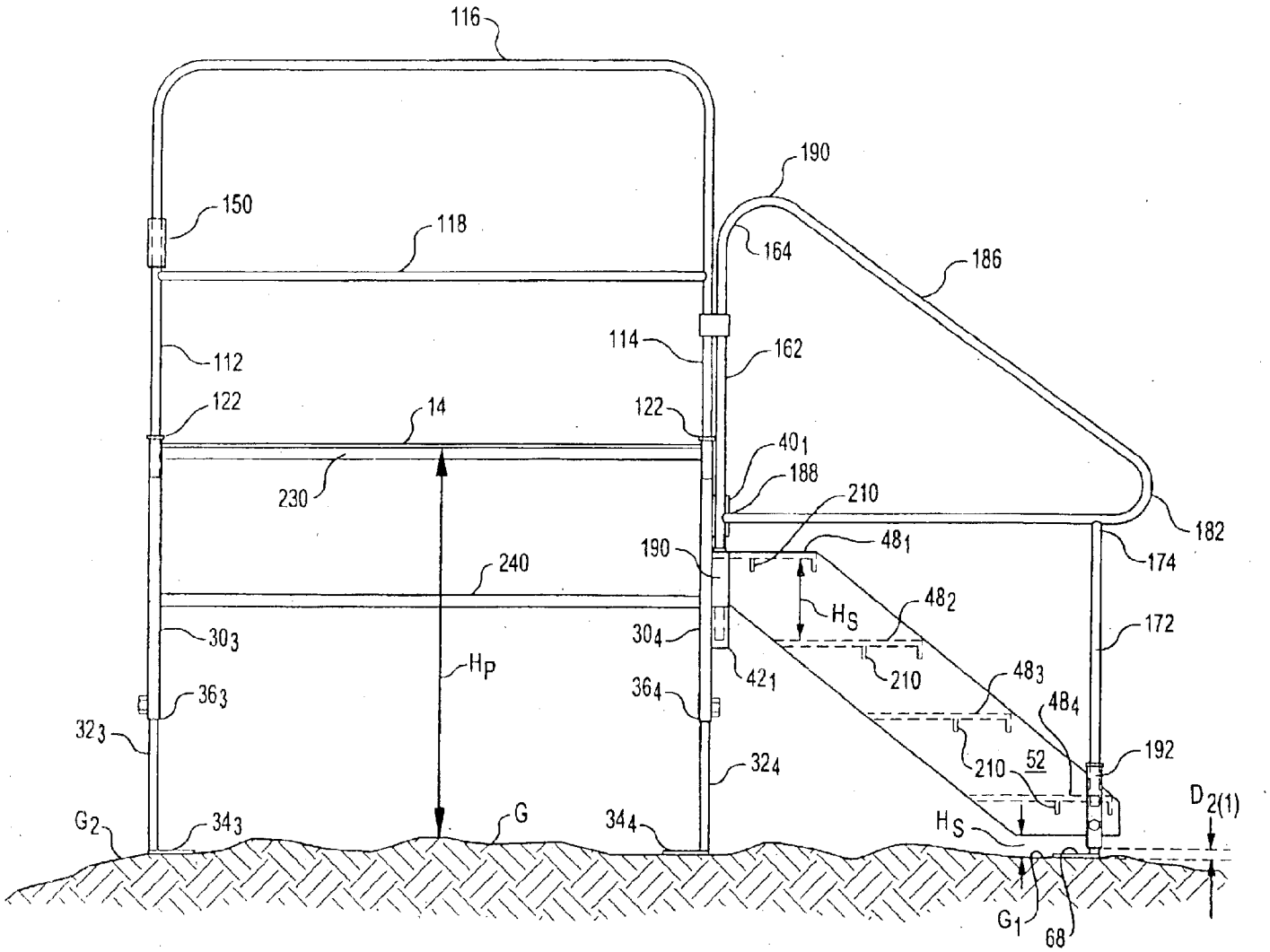
FIG. 5 is a side pictorial view of my portable stair system as first illustrated in FIG. 4, but now showing the stair assembly mounted to the lower stair receiving mounts of the structural framework for the main platform unit, and with the adjustable stair leg at a second, retracted length, and with one of the platform legs fully extended, retracted, but with another platform vertical support leg member almost fully extended, so as to provide level support of main platform unit over uneven ground.

To provide access to the deck 14 of the main platform unit 10, at least one stair unit 12 is provided. The stair unit has a predetermined length $L_S$, and is connectable with each of the upper stair receiving members $\mathbf{40}_1$ and $\mathbf{40}_2$ or alternately, with the lower stair receiving members $\mathbf{42}_1$, and $\mathbf{42}_2$, for secure, stable attachment at a desired height. As seen by comparison of FIGS. 4 and 5, the stairs 12 can be provided secured in a first position wherein a first stair member $\mathbf{48}_1$ is substantially even, heightwise, with the level of the deck 14. Alternately, the stairs 12 can be secured in a second position wherein a first stair member $\mathbf{48}_1$, is located below deck 14 by a height substantially equal to $H_s$, the height between first $\mathbf{48}_1$ and second $\mathbf{48}_2$ stair members. In the embodiment illustrated herein, four stairs, specifically first stair member $\mathbf{48}_1$, second stair member $\mathbf{48}_2$, third stair member $\mathbf{48}_3$, and fourth stair member $\mathbf{48}_4$ are provided.

Figure 2:
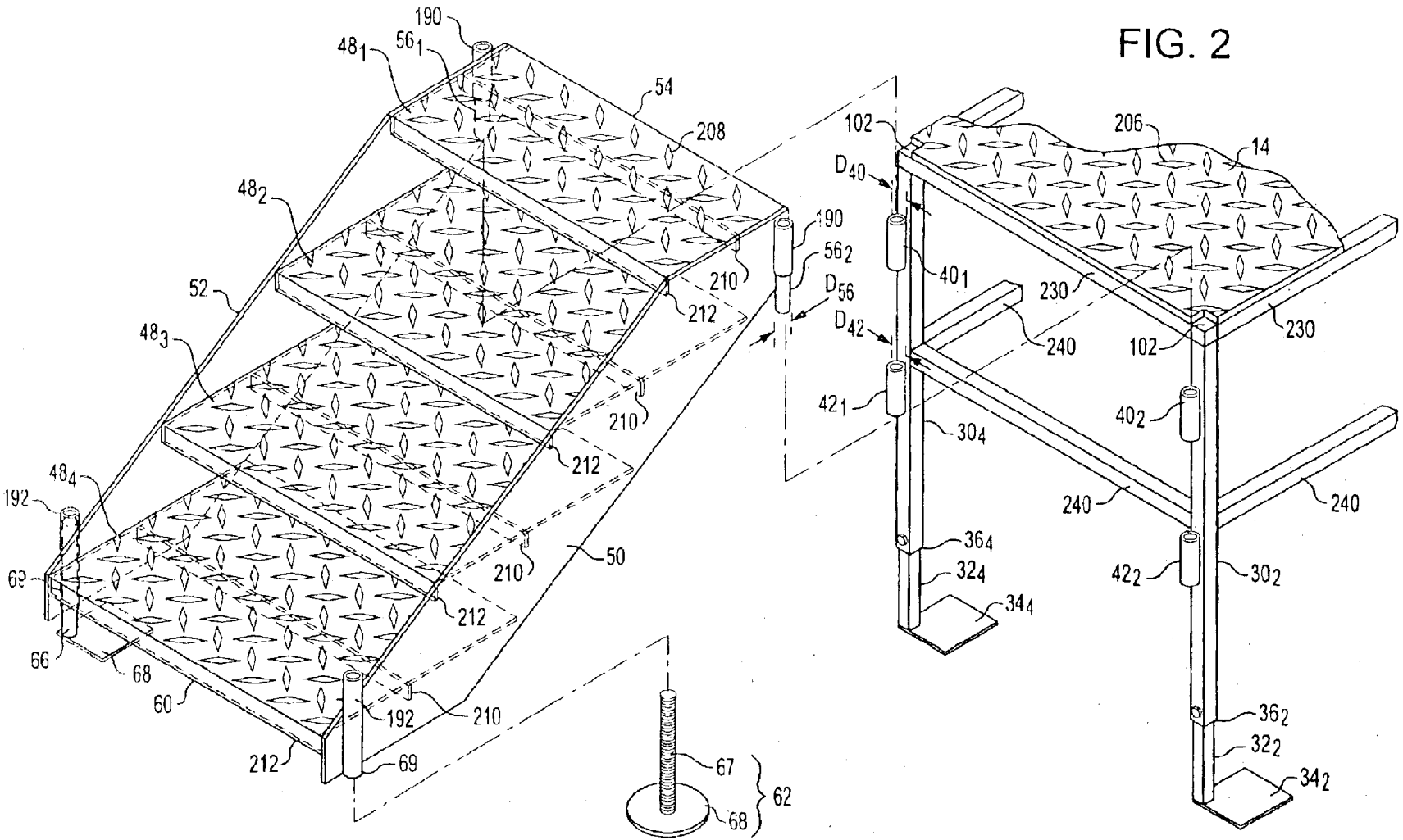
FIG. 2 is a partially exploded perspective view of my portable stair system, showing the stair assembly in a position for attachment to the upper stair unit receiving mounts on the structural framework of the platform unit, with one adjustable stair leg shown affixed to the stairs, and one adjustable stair leg removed from the stairs to reveal threads for adjustment, and with the platform legs extended downwardly.

A pair of opposing side panels 50 and 52 is provided for the stair unit 12. The stair unit has an upper end 54, at which is located at least one platform attachment member 56. In the embodiment illustrated, a pair of platform attachment members $\mathbf{56}_1$, and $\mathbf{56}_2$, each of which is sized and shaped for attachment to each of the upper stair receiving members $\mathbf{40}_1$ and $\mathbf{40}_2$ or alternately, to each of the lower stair receiving members $\mathbf{42}_1$ and $\mathbf{42}_2$, for secure, stable attachment of stairs 12 to platform unit 10 at a desired height $H_P$ above a substrate G such as the earth or a parking lot (see FIG. 5). Note that height $H_P$ may vary, below different portions of the deck 14, due to an uneven or non-level substrate G. As more easily seen in FIG. 2, attachment members $\mathbf{56}_1$ and $\mathbf{56}_2$ provide a cylindrical shape of outer diameter $D_{56}$ complementary to inner diameter $D_{40}$ of tubular cylindrical upper stair receiving members $\mathbf{40}_1$ and $\mathbf{40}_2$ or alternately, with inner diameter $D_{42}$ of tubular cylindrical lower stair receiving members $\mathbf{42}_1$ and $\mathbf{42}_2$.

The stair unit 12 also has a lower end 60, at which a first adjustable foot 62 having a ground engaging pad 64 is located, and at which a second adjustable foot 66 having a second ground engaging pad 68 is located. The first 62 and second 66 adjustable feet are independently vertically adjustable for securement of ground engaging pads and 68 at desired distances $D_1$ and $D_2$, respectively, below the lower end 60 of stair unit 12, thus supporting the lower end 60 of stair unit 12 at a desired distance $H_S$ above a selected substrate therebelow (see FIGS. 3 and 4). As noted in FIGS. 4 and 5, the distances $D_1$ and $D_2$ may have a first instance and a second instance (for example $D_2$ (1) and $D_2$ (2)) of varying height. As illustrated in the embodiment shown in FIGS. 1 and 2, the first 62 and second 66 adjustable feet are extensible and threadably adjustable via use of threaded shaft 67 acting with threaded foot receiver 69 to move feet 62 and 66 along a vertical axis.

As noted above, a plurality of steps 48 are positioned between said upper end 54 and the lower end 60 and between the pair of opposing side panels 50 and 52.

Importantly, the at least one stair unit 12 is adapted for attachment to the at least one platform unit 10 at the at least one upper stair receiving member $\mathbf{40}_1$ (and $\mathbf{40}_2$ as applicable), or alternatively, at the at least one lower stair receiving member $\mathbf{42}_1$ (and $\mathbf{42}_2$ as applicable), so as to enable utilization of the stairs 12 at a first selected height $H_s$ above a selected substrate $G_1$, and, by repositioning the stair unit 12, at a second selected height $H_s$ of the main platform unit 10 above a selected substrate $G_2$.

Figure 6:
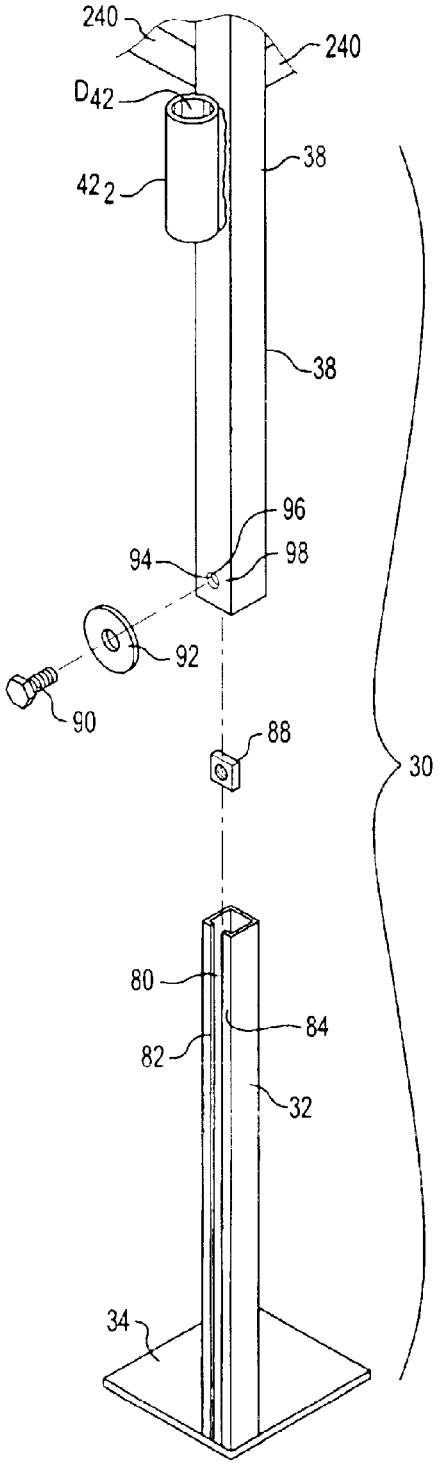
FIG. 6 shows in detail a vertical support leg member that supports the main platform unit, showing how a C-shaped portion in the lower member is adapted for adjustably nesting in an upper tubular member, and also showing a bolt and caged nut for securing the foot of the lower member at a selected height H below the lower end of the upper tubular member, so as to position the main platform unit in a level condition at a preselected distance above a substrate(e.g., earth or parking lot).
Figure 9:
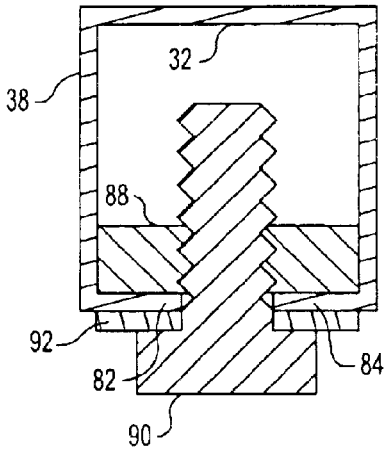
FIG. 9 shows, in cross-sectional view, the nesting of a C-shaped lower support member in an upper tubular member, as well as a caged nut, with external washer and bolt for securing the upper tubular member to the lower support member at a desired position.

Turning now to FIGS. 6 and 9, a better view can be seen of one of the substantially vertical support leg members 30, which is made up of an upper tubular member 38 and a lower support member 32. The lower support member 32 is slidingly nested in the upper tubular member 38. The upper tubular member 38 and the lower support member 32 are adapted for moving with respect each to the other along a common vertical axis. The upper tubular member 38 and the lower support member 32 are fixable in axial relationship so as to support the platform deck 14 at a selected vertical distance $H_P$ above a selected substrate G. In one embodiment, the lower support member 32 is provided as a generally C-shaped tubular member having a vertically running channel 80 defined by edge walls 82 and 84 of the C-shaped tubular member of a selected length. A nut 88 is located within the generally C-shaped tubular lower support member 32. A bolt 90, and a washer 92, are provided for affixing bolt 90 to nut 88. A bolt hole 94 defined by edge wall 96 is provided in the lower reaches 98 of the upper tubular member 38. The bolt hole 94 is aligned with the vertically running channel 80 in the lower support member 32, and is adapted to receive bolt 90 therethrough for securement with the nut 88. In the embodiment illustrated in FIGS. 6 and 9, the nut 88 is caged by the generally C-shaped tubular lower support member 32. The vertically running channel 82 in the lower support member 32 provides a slot for passage of the bolt 90 when the lower support member 32 is adjusted upwardly to nest in the upper tubular member 38, or when lower support member 32 is otherwise extensibly adjusted. As shown in FIG. 6, to facilitate the use of a caged nut, the nut 38 may be provided in a generally square configuration, so that the nut 88 is easily caged within the generally C-shaped tubular member 32. Although mentioned above, FIG. 6 also provides a view of the foot or foot plate 34, which is sized and shaped for transmitting a portion of a load from the platform unit to a substrate below, with a preselected force loading on said substrate, so that the platform unit is supported by the substrate G.

Returning now to FIG. 2, in one embodiment, the at least one upper stair receiving member 40 comprises at least two upper step mounting brackets $\mathbf{40}_1$ and $\mathbf{40}_2$. Two of the at least two upper step mounting brackets $\mathbf{40}_1$ and $\mathbf{40}_2$ are spaced apart along a longitudinal axis to opposite sides of one side portion (here, side 22) of the platform unit 10 in a matched, spaced relationship to the platform attachment members $\mathbf{56}_1$ and $\mathbf{56}_2$ on stair unit 12. In one embodiment illustrated, a pair of upper step mounting brackets $\mathbf{40}_1$ and $\mathbf{40}_2$ is provided. Likewise, the at least one lower stair receiving member 42 comprises at least two lower step mounting brackets $\mathbf{42}_1$ and $\mathbf{42}_2$. Two of the at least two lower step mounting brackets $\mathbf{42}_1$ and $\mathbf{42}_2$ are spaced apart along a longitudinal axis to opposite sides of one side portion (here, side 22) of the platform unit 10 in a matched, spaced relationship to the platform attachment members $\mathbf{56}_1$ and $\mathbf{56}_2$ on stair unit 12. In one embodiment illustrated, a pair of lower step mounting brackets $\mathbf{42}_1$ and $\mathbf{42}_2$ is provided. In one embodiment, each of the at least one upper stair receiving members is provided in the form of a tubular member welded to one of said substantially vertical support leg members 30. In similar fashion, in one embodiment each one of the at least one lower stair receiving members is provided in the form of a tubular member welded to one of said substantially vertical support leg members 30.

The apparatus illustrated in FIGS. 1, 2, 4, and 5 utilizes a configuration wherein the at least one platform attachment member 56 at the upper end of the at least one stair 12 includes at least two pocket pins, and more specifically a pair of pins $\mathbf{56}_1$ and $\mathbf{56}_2$, which are each sized and shaped for close fitting mating engagement within one of the at least two upper step mounting brackets $\mathbf{40}_1$ and $\mathbf{40}_2$. Likewise, the at least one platform attachment member 56 at the upper end of the at least one stair 12 includes at least two pocket pins, and more specifically a pair of pins $\mathbf{56}_1$ and $\mathbf{56}_2$, which are each sized and shaped for close fitting mating engagement within one of the at least two lower step mounting brackets $\mathbf{42}_1$ and $\mathbf{42}_2$.

Figure 3:
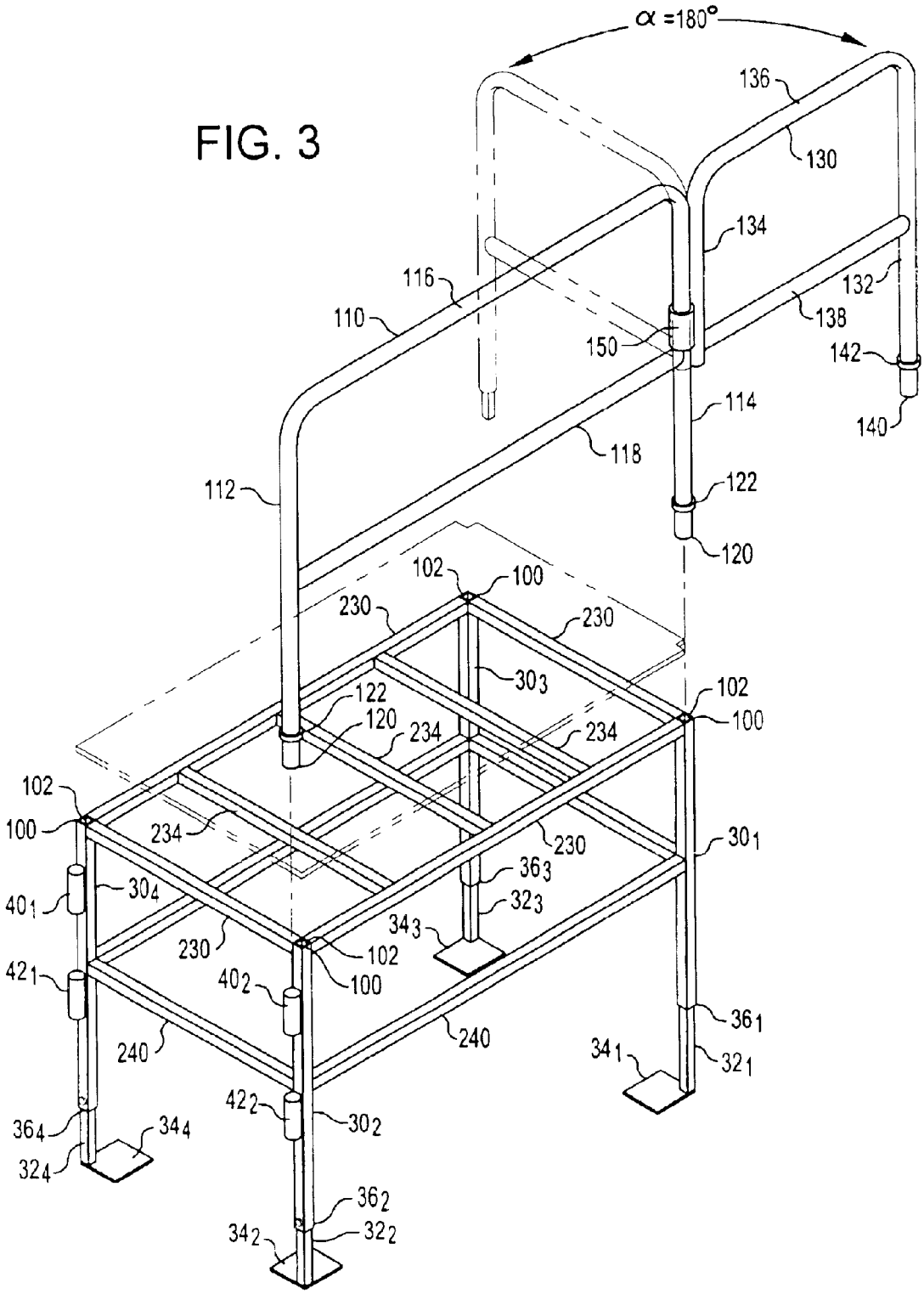
FIG. 3 is perspective view of the structural framework below the deck of a platform unit, and also showing, at the upper end of the vertical support leg members, receivers adapted to receiving the lower ends of columns of the main platform hand rail frame and the main platform end rail hand rail frame, and also showing the pivotally mounted main platform end rail frame.

Turning now to FIGS. 1 and 3, it should be noted that each of the vertical support leg members 30 have, at the upper end 100 thereof, a receiver 102. A main platform unit hand rail side frame 110 is provided. The main platform unit hand rail side frame 110 has a pair of vertically oriented main platform rail column members 112 and 114, and running therebetween, an upper horizontal rail 116, and a central horizontal rail 118. Each of the vertically oriented main platform rail column members 112 and 114 have a lower end 120, and, spaced upward from lower end 120, a stop 122. Each of the vertically oriented main platform rail column members 112 and 114 are sized and shaped for placement downwardly into a receiver 102 until stop 122 is reached, so that a vertically standing, secure main platform unit hand rail side frame 110 is provided.

Additionally, a unique, interchangeable main platform end hand rail frame 130 is provided. The main platform unit end frame 130 has a vertically oriented main platform end hand rail column member 132, and a vertically oriented main platform end hand rail partial column member 134, and running therebetween, an upper horizontal end rail 136 and a central horizontal end rail 138. The vertically oriented main platform end rail column member 132 has a lower end 140, spaced upward from the lower end 140, a stop 142. The vertically oriented main platform end rail column member 132 is sized and shaped for placement downwardly into a receiver 102 until stop 142 is reached.

Importantly, the main platform end hand rail partial column member 134 is secured to, for pivotal movement with respect to, one of the main platform rail column members, 112 or 114, so that a vertically standing, secure main platform unit hand rail side frame is provided. In this manner, the same main platform end hand rail frame unit 130 is usable whether on the right hand side (when oriented facing rising stairs), or on the left hand side (when oriented facing rising stairs) of platform unit 10. One configuration useful for providing such a pivotally connected apparatus as just described is shown in FIG. 3, where the main platform end hand rail frame 130 is pivotally secured to a vertical oriented main platform rail column member (here, column 114) via a sleeve 150. In this configuration, the vertically oriented main platform rail column member 114 is a cylindrical tubular member having an outer diameter $D_{114}$, and the sleeve 150 is sized and shaped larger than (with inner diameter $D_{150}$), but complementary to and designed for close fitting engagement with, the outer diameter $D_{114}$ of the vertically oriented main platform rail column member 114. The sleeve 150 is securely affixed to the main platform end hand rail partial column member 114, and thus securely affixes the main platform unit hand rail side frame 110 with the main platform unit end rail frame 130. As shown in FIGS. 1, 3, 4, and 5, the sleeve 150 is vertically affixed to the main platform end hand rail partial column member 114. As noted in FIG. 3, the main platform end hand rail frame 130 is free to pivot by at least an angle alpha of 180°, so that the main platform side rail frame 110 can be utilized either on the left hand or on the right hand side of the main platform unit 10.

For safety, the stair unit 12 is provided with a step hand rail frame 160. The step hand rail frame 160 has an upper column member 162. The upper column member 162 has an upper end 164, a middle portion 166, and a lower end 168. Spaced upwardly from the lower end 168 is a stop 170. The step hand rail frame 160 also has a lower column member 172. The lower column member 172 has an upper end 174, and lower end 176. Spaced upwardly from the lower end 176 is a stop 178. A horizontally oriented generally V-shaped rail member 180 is provided, and, in one embodiment, as an integral part of step hand rail frame 170. The horizontally oriented generally V-shaped rail member 180 has an apex end 182, a first leg 184, and a second leg 186. The first leg 184 is oriented generally horizontally and has an outer end 188 affixed to the middle portion 166 of the upper column member 162. The second leg 186 has an outer end 190 affixed to the upper end 164 of the upper column member 162. Near the apex end 182, the horizontally oriented generally V-shaped rail member 180 is affixed to the upper end 174 of the lower column member 172.

To secure the stair rail frame unit 130 to the stairs 12, lower ends 168 and 176 of upper column member 162 and lower column member 172, respectively, are inserted into either the left hand or right hand set of upper stair rail receiving pockets 190 and lower stair rail receiving pockets 192.

Figure 7:
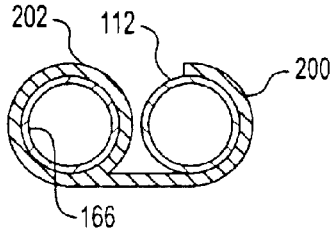
FIG. 7 shows, in cross-sectional view, one embodiment for a slidable sleeve and J-latch for connecting the stair hand rail frame to the main platform unit hand rail frame.

To secure the stair rail frame unit 130 to the main platform unit hand rail frame 110, a hook 200 is displaceably affixed (such as via hook sleeve 202 that is slidable over upper column member 172, see FIG. 7) to the upper column member 172 between the upper end 164 and the middle portion 166. The hook 200, as shown, may be provided in a generally J-shaped configuration sized and shaped for secure, linking engagement with one of the vertical oriented main platform rail column members (here, column 112) so as to secure the step hand rail frame 130 to the main platform unit hand rail frame 110.

In one embodiment, as generally illustrated herein, the main platform unit 10 comprises a deck 14 portion generally rectangular in planar shape, but this disclosure should not be considered so limited, as the teachings provided herein may be utilized in many desired shapes for a deck 14. Also, it is generally desirable, but not absolutely necessary, that deck 14 be provided with a slip resistant surfacing such as the diamond plate design 206 shown in FIG. 2. Likewise, generally desirable, but not absolutely necessary, that steps $\mathbf{48}_1$, $\mathbf{48}_2$, $\mathbf{48}_3$, and $\mathbf{48}_4$, etc., of stairs 12 be provided with a slip resistant surfacing such as the diamond plate design 208 shown in FIG. 2.

For strength, various additional features are desirable. First it is often desirable, and depending on step plate thickness, perhaps necessary, that some or all of the steps $\mathbf{48}_1$, $\mathbf{48}_2$, $\mathbf{48}_3$, and $\mathbf{48}_4$, etc., of stairs 12 be provided with a vertically oriented, longitudinally running stiffener portion 210 extending between said opposing side panels 50 and 52. Also, a stiffening lip 212 is desirable on each of the steps $\mathbf{48}_1$, $\mathbf{48}_2$, $\mathbf{48}_3$, and $\mathbf{48}_4$, etc. Next, the structural support framework 24 to support the platform unit 10 includes, in one embodiment, a plurality of upper perimeter tubular frame members or upper braces 230. The plurality of upper perimeter tubular frame members 230 include upper tubular frame members 230 running between, and affixed to, each one of the plurality of substantially vertical support leg members 30. Where, as shown in FIG. 3, the platform unit 10 and deck 14 are rectangular, each one of the vertical support leg members 30 may be positioned at a corner of the rectangular platform unit 10.

As seen in FIG. 3, in one embodiment, the platform unit 10 apparatus has a structural support framework 24 that further includes a plurality of floor beam members 234. The floor beam members 234 are affixed to, and run between, two of the plurality of upper perimeter tubular frame members 230.

Figure 8:
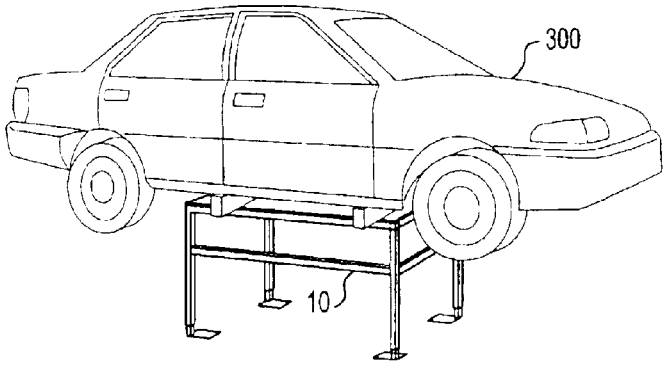
FIG. 8 shows the strength of the structural support framework to support the platform unit, where a test is in progress to support an automobile from the structural support framework.

Also, the structural support framework 24 desirably further includes a plurality of intermediate perimeter tubular frame members 240. The plurality of intermediate perimeter tubular frame members or center braces 240 desirably include intermediate tubular frame members 240 running between, and affixed to, each one of the plurality of substantially vertical support leg members 30. The overall-strength provided by the design just described for platform unit 10 can be further appreciated by reference to FIG. 8, which illustrates the platform unit 10 supporting an automobile 300.

In summary, the portable stair system described herein is simple to assembly and install. The platform stair handrail needs no additional bolts or other hardware to assemble, and thus it will be one of the most readily installed systems available. As illustrated, the portable stair system mounts in two different positions. An upper or high position makes the first step a part of the platform deck. A lower position adds one more step. Also, the stair assembly has adjustment legs. As illustrated, the adjustment legs of the stair assembly are adjustable from a height of about 2 inches above the ground to as much as about 8 inches from the ground. In conjunction with adjustment of the vertical legs 30, an adjustment in height of deck 14 from about 26 inches to about 40 inches from the substrate G is easily accomplished.

The platform handrail is unique in that it incorporates a swivel hinge, making it possible to be installed on either the right side or on the left side of the deck 14. As illustrated, the step rail must be mounted first, and the hook fastener will slide up and down on the step rail vertical column. Then, the platform rail is installed, which using the hook described herein, locks the steps and rail in place, making it possible to slide together, without the need for bolts, pins, or clips.

Importantly, the portable platform stair system is manufactured of strong, yet lightweight materials. Normally, a strong steel frame is provided to meet the anticipated loads. However, it is to be understood that other materials of construction can be utilized, such as structural composites, etc., and advantageously utilize the adjustable step structures described herein.

It is to be appreciated that my portable stair system for portable office buildings is an appreciable improvement in the art of portable stairs. My novel design addresses the problem of how to provide for differing building height, as well as for uneven ground, while minimizing the labor requirement for installation and for removal, to provide a significantly portable stair system. Although only a few exemplary embodiments have been described in detail, various details are sufficiently set forth in the drawings and in the specification provided herein to enable one of ordinary skill in the art to make and use the invention(s), which need not be further described by additional writing in this detailed description. It will be readily apparent to those skilled in the art that my portable stair system structure may be modified from those embodiments provided herein, without materially departing from the novel teachings and advantages provided.

The aspects and embodiments described and claimed herein may be modified from those shown without materially departing from the novel teachings and advantages provided by this invention, and may be embodied in other specific forms without departing from the spirit or essential characteristics thereof. Therefore, the embodiments presented herein are to be considered in all respects as illustrative and not restrictive. As such, this disclosure is intended to cover the structures described herein and not only structural equivalents thereof, but also equivalent structures. Numerous modifications and variations are possible in light of the above teachings. It is therefore to be understood that within the scope of the appended claims, the invention (s) may be practiced otherwise than as specifically described herein. Thus, the scope of the invention(s), as set forth in the appended claims, and as indicated by the drawing and by the foregoing description, is intended to include variations from the embodiments provided which are nevertheless described by the broad interpretation and range properly afforded to the plain meaning of the claims set forth below.

What is claimed is:

1. An adjustable platform and stair system, comprising:

(a) at least one platform unit of a preselected dimensions and having a plurality of side portions, said platform unit further comprising a structural support framework to support said platform unit, said framework comprising a plurality of substantially vertical support leg members, each of said vertical support leg members further comprising a vertically displaceable slide portion, each of said slide portions securable at a desired height with respect to a selected substrate therebelow, along at least one of said plurality of side portions, at least one upper stair receiving member and at least one lower stair receiving member, each of said upper and lower stair receiving members affixed to a portion of said structural support framework;

(b) at least one stair unit, said at least one stair unit having a predetermined length and connectable with said at least one upper stair receiving member or with said at least one lower stair receiving member on said at least one platform unit, said at least one stair unit further comprising a pair of opposing side panels, an upper end, said upper end further comprising at least one platform attachment member, said at least one platform attachment member sized and shaped for attachment to said at least one upper stair receiving member, or to said at least one lower stair receiving member, a lower end, said lower end further comprising a first adjustable foot and a second adjustable foot, said first and second adjustable feet independently vertically adjustable for securement at a desired height with respect to a selected substrate therebelow, and a plurality of steps positioned between said upper end and said lower end and between said pair of side panels;

(c) wherein said at least one stair unit is adapted for attachment to said at least one platform unit at said at least one upper stair receiving member, or at said at least one lower stair receiving member, so as to enable utilization of said at least one stair unit at a first selected height of said platform above a selected substrate, and, by repositioning said at least one stair unit, at a second selected height of said at least one platform above said selected substrate, wherein each of said vertical support leg members further comprises, at the upper end thereof, a receiver, and wherein said apparatus further comprises a main platform unit hand rail side frame, said main platform unit hand rail side frame comprising a pair of vertically oriented main platform hand rail column members, and running therebetween, am upper horizontal rail and a central horizontal rail, and wherein each of said vertically oriented main platform hand rail column members have a lower end, and, spaced upward from said lower end, a stop, and wherein each of said vertically oriented main platform hand rail column members are size and shaped for placement into a receiver, so that a vertically standing, secure main platform unit hand rail side frame is provided, further comprising a main platform unit end hand rail frame, said main platform unit end hand rail frame comprising a vertically oriented main platform end hand rail column member, and a vertically oriented main platform end hand rail partial column member, and running therebetween, an upper horizontal end rail and a central horizontal end rail, and wherein said vertically oriented main platform end rail column member has a lower end, and, spaced upward from said main platform end rail column member lower end, a stop, and wherein said vertically oriented main platform end rail column member is size and shaped fro placement into a receiver, and wherein said main platform end hand rail partial column member is secured to, for pivotal movement with respect to, one of said main platform hand rail column members, so that a vertically standing, secure main platform unit end hand rail frame is provided, wherein said main platform unit end hand rail frame is pivotally secured to a vertically oriented main platform hand rail column member via a sleeve, and wherein said vertically oriented main platform hand rail column member is a cylindrical tubular member having an outer diameter, and wherein said sleeve is size and shape larger than, but complementary to for close fitting engagement with, said outer diameter of said vertically oriented main platform hand rail column member, and wherein said sleeve is securely affixed to said main platform end hand rail partial column member.

2. The apparatus as set forth in claim 1, wherein each of said first and said second adjustable feet are threadably adjustable along a vertical axis.

3. The apparatus as set forth in claim 1, wherein each of said of substantially vertical support leg members comprises an upper tubular member and a lower support member, said lower support member nested in said upper tubular member, said upper tubular member and said lower support member adapted for moving with respect each to the other along a common vertical axis.

4. The apparatus as set forth in claim 3, wherein said upper tubular member and said lower support member are fixable in axial relationship so as to support said platform at a selected vertical distance above a selected substrate.

5. The apparatus as set forth in claim 3, wherein said lower support member comprises a generally C-shaped tubular member defining a vertically running channel.

6. The apparatus as set forth in claim 5, wherein each of said substantially vertical support leg members further comprises a caged nut located within said generally C-shaped tubular member, a bolt, a bolt hole in the lower reaches of said upper tubular member, said bolt hole aligned with said vertically running channel in said lower support member and adapted to receive said bolt therethrough for securement with said caged nut, and wherein said vertically running channel in said lower support member provides a slot for passage of said bolt when said lower support member is adjusted upwardly to nest in said upper tubular member.

7. The apparatus as set forth in claim 6, wherein said caged nut is in a generally square configuration, and wherein said caged nut is caged within said generally C-shaped tubular member.

8. The apparatus as set forth in claim 1, wherein each of said substantially vertical support leg members further comprises, at the lower end thereof, a foot plate, said foot plate sized and shaped for transmitting a portion of a load from said apparatus to a substrate below with a preselected force loading on said substrate.

9. The apparatus as set forth in claim 1, wherein said at least one upper stair receiving member comprises at least two upper step mounting brackets, and wherein two of said at least two upper step mounting brackets are spaced apart to opposite sides of said at least one stair unit.

10. The apparatus as set forth in claim 1, wherein said at least one upper stair receiving member comprises a pair of upper step mounting brackets, said pair of upper step mounting brackets spaced apart to opposite sides of said at least one stair unit.

11. The apparatus as set forth in claim 1, wherein said at least one lower stair receiving member comprises at least two lower step mounting brackets, and wherein two of said at least two lower step mounting brackets are spaced apart to opposite sides of said at least one stair unit.

12. The apparatus as set forth in claim 1, wherein said at least one lower stair receiving member comprises a pair of lower step mounting brackets, said pair of lower step mounting brackets spaced apart to opposite sides of said at least one stair unit.

13. The apparatus as set forth in claim 9, wherein said at least one platform attachment member at said upper end of said at least one stair comprises at least two pocket pins, said pocket pins sized and shaped for close fitting mating engagement within one of said at least two upper step mounting brackets.

14. The apparatus as set forth in claim 10, wherein said at least one platform attachment member at said upper end of said stair comprises a pair of pocket pins, each of said pocket pins sized and shaped for close fitting mating engagement within one of said mounting brackets in said pair of upper step mounting brackets.

15. The apparatus as set forth in claim 11, wherein said at least one platform attachment member at said upper end of said at least one stair comprises at least two pocket pins, said pocket pins sized and shaped for close fitting mating engagement within one of said at least two lower step mounting brackets.

16. The apparatus as set forth in claim 12, wherein said at least one platform attachment member at said upper end of said stair comprises a pair of pocket pins, each of said pocket pins sized and shaped for close fitting mating engagement within one of said mounting brackets in said pair of lower step mounting brackets.

17. The apparatus as set forth in claim 1, wherein said sleeve is vertically affixed to said main platform end hand rail partial column member.

18. The apparatus as set forth in claim 1, further comprising a step hand rail frame, said step hand rail frame comprising an upper column member, said upper column member having an upper end, a middle portion, and a lower end, and spaced upwardly from said lower end, a stop, a lower column member, said lower column member having an upper end and a lower end, and spaced upwardly from said lower end, a stop, a horizontally oriented generally V-shaped rail member, said horizontally oriented generally V-shaped rail member having an apex end, a first leg, and a second leg, said first leg oriented generally horizontally and having an outer end affixed to said middle portion of said upper column member, and said second leg having an outer end affixed to said upper end of said upper column member, and wherein at or near said apex, said horizontally oriented generally V-shaped rail member is affixed to said upper end of said lower column member.

19. The apparatus as set forth in claim 18, further comprising a hook, said hook affixed to said upper column member between said upper end and said middle portion, said hook sized and shaped for secure, linking engagement with one of said vertical oriented main platform rail column members, so as to secure said step hand rail frame to said main platform unit hand rail frame.

20. The apparatus as set forth in claim 1, wherein said main platform unit comprises a deck portion generally rectangular in planar shape.

21. The apparatus as set forth in claim 20, wherein said deck comprises a slip resistant surfacing.

22. The apparatus as set forth in claim 1, wherein at least one of said plurality of steps comprises a slip resistant surfacing.

23. The apparatus as set forth in claim 1, wherein each one of said plurality of steps further comprises, extending between said opposing side panels a vertically oriented, longitudinally running stiffener portion.

24. The apparatus as set forth in claim 1, wherein said a structural support framework to support said platform unit comprises a plurality of upper perimeter tubular frame members, said plurality of upper perimeter tubular frame members including upper tubular frame members running between, and affixed to, each one of said plurality of substantially vertical support leg members.

25. The apparatus as set forth in claim 24, wherein said platform unit is rectangular, and wherein each one of said vertical support leg members is positioned at a corner of said rectangular platform unit.

26. The apparatus as set forth in claim 25, wherein said structural support framework further comprises a plurality of floor beam members, said floor beam members affixed to, and running between, two of said plurality of upper perimeter tubular frame members.

27. The apparatus as set forth in claim 24, wherein said structural support framework to support said platform unit further comprises a plurality of intermediate perimeter tubular frame members, said plurality of intermediate perimeter tubular frame members including intermediate tubular frame members running between, and affixed to, each one of said plurality of substantially vertical support leg members.

28. The apparatus as set forth in claim 1, wherein each of said at least one upper stair receiving members comprises a tubular member welded to one of said substantially vertical support leg members.

29. The apparatus as set forth in claim 1, wherein each of said at least one lower stair receiving members comprises a tubular member welded to one of said substantially vertical support leg members.

30. The apparatus as set forth in claim 1, wherein said at least one stair unit includes means for leveling said at least one stair unit when connected to said main platform unit.

31. The apparatus as set forth in claim 1, wherein said main platform unit includes means for leveling said main platform unit with respect to said selected substrate therebelow.

32. The apparatus as set forth in claim 18, wherein said apparatus further comprises means for securing said step hand rail side frame to said main platform hand rail frame.

33. The apparatus as set forth in claim 1, wherein said at least one stair unit comprises a single stair unit having four steps.

* * * * *